US006915670B2

(12) United States Patent
Gogel

(10) Patent No.: US 6,915,670 B2
(45) Date of Patent: Jul. 12, 2005

(54) SECURITY DEVICE FOR ROLL-UP DOORS

(76) Inventor: Roy E. Gogel, 218 E. Cranberry La., Greenville, SC (US) 29615

( * ) Notice: Subject to any disclaimer, the term of this patent is extended or adjusted under 35 U.S.C. 154(b) by 0 days.

(21) Appl. No.: 10/975,233

(22) Filed: Oct. 28, 2004

(65) Prior Publication Data

US 2005/0056062 A1 Mar. 17, 2005

Related U.S. Application Data

(63) Continuation-in-part of application No. 10/651,686, filed on Aug. 29, 2003, now Pat. No. 6,823,701.

(51) Int. Cl.[7] ..... E05B 65/08; E05B 67/38

(52) U.S. Cl. ..... 70/32; 70/56; 70/95; 70/100; 70/129; 292/148

(58) Field of Search ..... 70/95, 99, 100, 70/54–56, 32–34, 129, DIG. 43, DIG. 56, 202, 203, 211, 212; 292/148, 205, 218, DIG. 32

(56) References Cited

U.S. PATENT DOCUMENTS

| | | | | | |
|---|---|---|---|---|---|
| 3,976,318 | A | | 8/1976 | Krus | 292/346 |
| 4,095,828 | A | * | 6/1978 | East | 292/148 |
| 4,345,448 | A | * | 8/1982 | Solomon | 70/95 |
| 4,688,409 | A | * | 8/1987 | Oliver et al. | 70/417 |
| 4,883,294 | A | * | 11/1989 | Goodspeed | 292/148 |
| 5,168,258 | A | | 12/1992 | Radke | 340/542 |
| 5,172,574 | A | * | 12/1992 | Perfetto | 70/56 |
| 5,946,952 | A | * | 9/1999 | Mintchenko | 70/2 |
| 6,009,731 | A | * | 1/2000 | Emmons et al. | 70/56 |
| 6,058,745 | A | | 5/2000 | Sanchez | 70/56 |
| 6,233,984 | B1 | | 5/2001 | Blehi, III | 70/34 |
| 6,367,292 | B1 | | 4/2002 | Bunger | 70/56 |
| 6,442,982 | B1 | * | 9/2002 | Larsen et al. | 70/3 |
| 6,463,769 | B1 | | 10/2002 | Garner | 70/56 |
| 6,494,064 | B1 | | 12/2002 | Pena | 70/56 |
| 6,668,601 | B1 | * | 12/2003 | Reddick | 70/56 |
| 6,823,701 | B1 | * | 11/2004 | Gogel | 70/32 |

* cited by examiner

*Primary Examiner*—Lloyd A. Gall
(74) *Attorney, Agent, or Firm*—Charles L. Schwab; Nexsen Pruet, LLC

(57) ABSTRACT

A security device is provided which may be installed on a roll-up door of a cargo container garage or storage facility. The security device includes a locking bar having a locking pin, which is shiftable into a locking pin receiving aperture in a side wall of the roll-up doorframe. The locking bar also includes a tab with an opening for receiving the locking rod of a puck shaped lock when the locking bar is in the locking position.

7 Claims, 2 Drawing Sheets

SECURITY DEVICE FOR ROLL-UP DOORS

RELATED APPLICATION

Features of this invention are disclosed in and is a continuation in part of U.S. patent application Ser. No. 10/651,686 filed Aug. 29, 2003 now U.S. Pat. No. 6,823,701 for a Door Latching Device for which benefit under 35 U.S.C. 120 is claimed.

BACKGROUND OF THE INVENTION

This invention is a device for preventing unauthorized opening of the roll-up door of a cargo container of the type used on truck trailers or roll-up doors of garages, warehouses, or mini-storage warehouses. The roll-up door of such installations is customarily secured with rollers that slide or roll within glides that are mounted within the door frame on laterally opposite sides of the rear of the trailer or the entrance way to the garage or mini-storage. The doors have hinged horizontal panels that fold as the door is opened by being slid, customarily in an upward direction, along glides that typically turn inward of the trailer or garage at an angle approximating ninety degrees. Although various locking devices have been proposed for securing roll-up doors, thieves using bolt cutters, power hack saws and sledge hammers are all too frequently destroying the locking devices that are mounted externally on these doors.

SUMMARY OF THE INVENTION

The security device of this invention locks the panel of the roll-up door to one of the laterally opposing door frames and not the glides, thus preventing the door of the container or garage, warehouse, or mini-storage warehouse, from being opened. This security device may be semi-portable; that is, it could or could not be permanently secured to the door or the door frame. This invention provides a door security device for use with a lock that protects the lock from unauthorized tampering. These and other objects of the invention are accomplished by providing a securing device to secure a door in its closed position. The securing device includes a rigid housing with an approximate forty-five degree angle top to thwart destruction by hand tools such as sledge hammers. It includes an attachment bolt that, when affixed with a hex nut, secures the securing device to the door. It also includes a locking bar guide channel, a slidable locking bar with a locking pin and a lock receiving hole for the locking rod of a separate lock. The rigid housing includes an opening for receiving the lock, an opening providing limited access to a keyhole of the lock and a locking pin ingress/egress opening. In a locking or secured position, the locking pin protrudes from the housing, and the lock is coupled with the locking bar to prevent movement of the same. In an unsecured position, the lock is uncoupled from the lock receiving hole of the slidable locking bar to permit displacement of the locking pin. The housing provides limited access to the lock once the lock is coupled with the lock receiving hole of the locking bar. The securing device is mounted substantially adjacent to a door frame that includes an aperture for receiving the locking pin.

BRIEF DESCRIPTION OF THE DRAWINGS

One embodiment of the invention is shown in the accompanying drawings, in which.

DETAILED DESCRIPTION OF THE INVENTION

The present invention is a securing device particularly suited for securing a roll-up door in its closed position. Additionally, the present invention is a door securing system for securing a door in its closed position using a conventional hockey puck style lock. The securing device is ideally suited for mounting on a roll-up door, such as found on tractor trailer doors, warehouse dock doors, and mini-storage doors, and to releasably secure it to its door frame. Locks that use either mechanical or electronic keys are preferably used with the securing device.

The securing device may be used to secure the door in any desired position depending on the relationship of the door with respect to the corresponding immoveable object, such as a doorframe. Depending on the mounting location of the latching device and the location of a locking pin receive aperture, the door may be secured in a closed position or partially open position. For example, depending on the mounting of the locking device and the location of the locking pin receiving aperture in the doorframe, the garage door may be partially opened and secured in such partially opened position by sliding the locking pin into the receiving aperture and locking the securing device.

Figure 1:
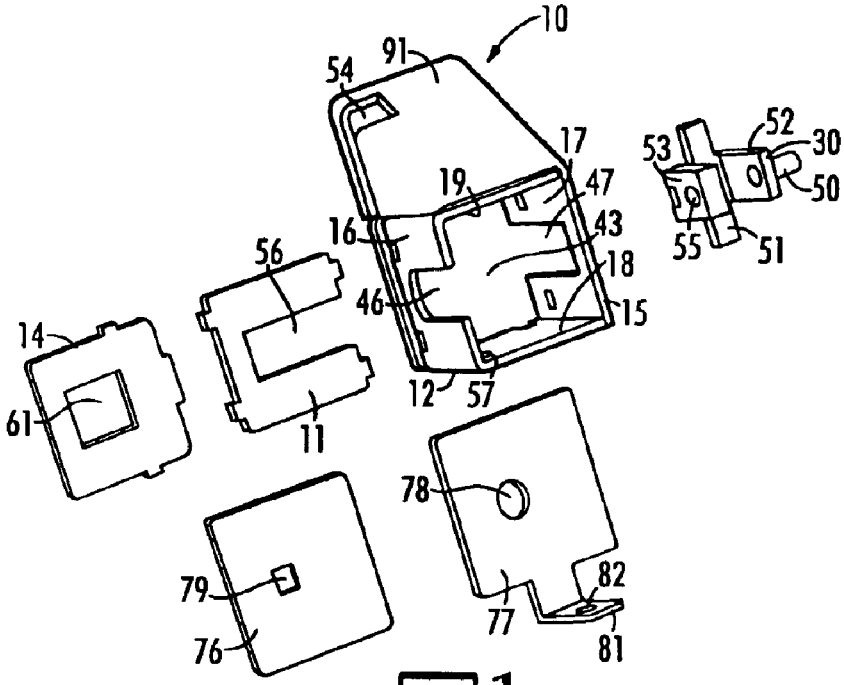
FIG. 1 is a partially exploded view showing components of the securing device of the present invention.
Figure 2:
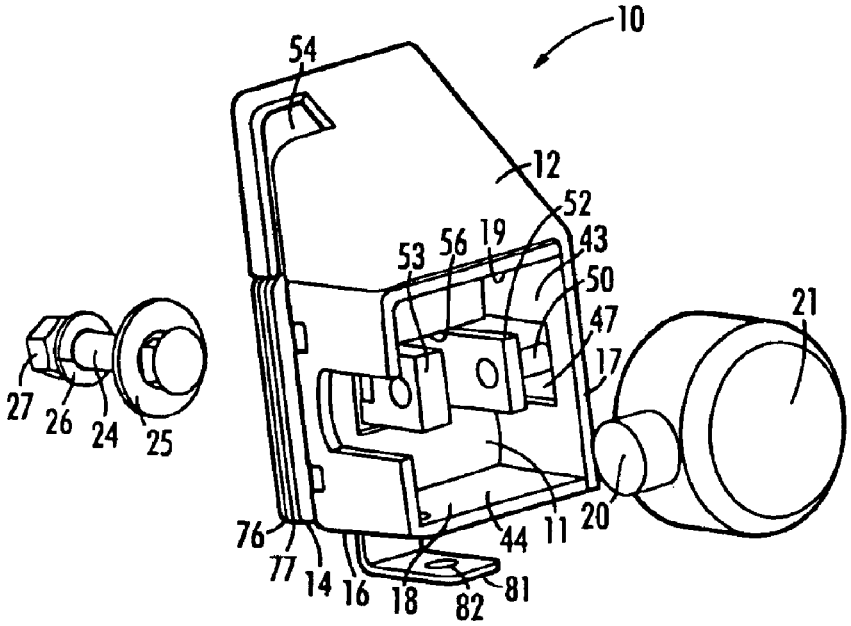
FIG. 2 is a perspective view of the securing device, a lock and fastening components prior to emplacement and securing the lock.
Figure 3:
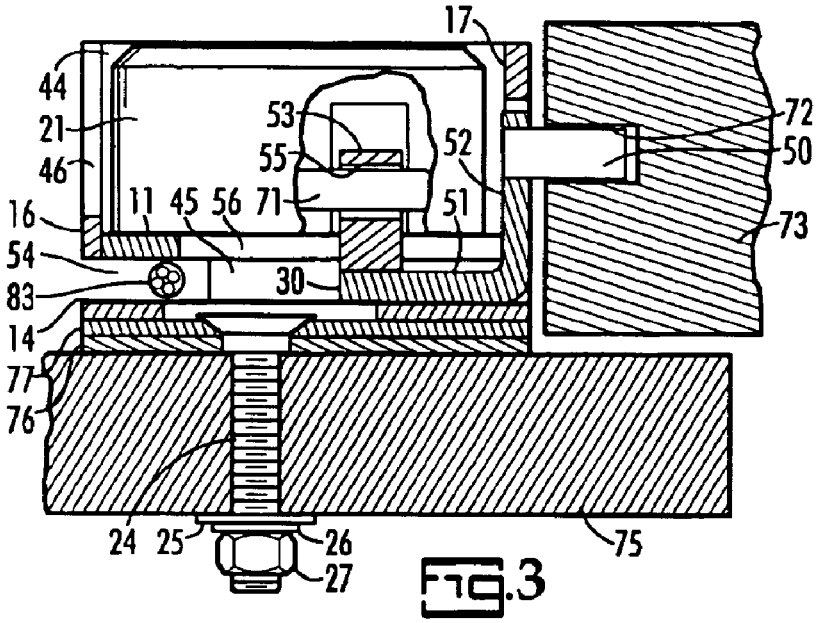
FIG. 3 is a section taken on line 3—3 in FIG. 4 showing a shackleless puck lock coupled with the securing device in its locking position.

Referring to FIGS. 1, 2 and 3, the security device 10 includes a rigid housing 12 and a sliding or reciprocable locking bar 30. The housing 12 has a rear wall 14 and a side wall structure 15 including a pair of laterally opposite side walls 16, 17, a lower wall 18 and an upper wall 19 rigidly secured by welding to form a chamber 43 with a front opening. The side wall 17, the lower wall 18 and the upper wall 19 are rigidly secured, as by welding, to the rear wall 14, which has a bolt access opening 61. A partition wall 11, which is rigidly secured as by welding to the side wall structure 15, divides the chamber 43 into an outer compartment 44 for receiving a puck shaped shackeless lock 21 and an inner compartment 45. The partition wall 1, which is spaced from and parallel to the back wall 14 includes a centrally positioned locking bar guide channel 56. The side wall 16 includes a slot 46, for accessing a key receiving portion 20 of the lock 21. The width of the slot 46 is only slightly greater than the diameter of the key receiving portion 20 of the lock 21, so as to restrict access to the lock 21. In the unlocked condition of the lock 21, as shown in FIG. 2, the key receiving portion 20 extends through the slot 46. The side wall 17 includes a rectangular shaped opening 47 in alignment with the reciprocable locking bar 30.

Figure 4:
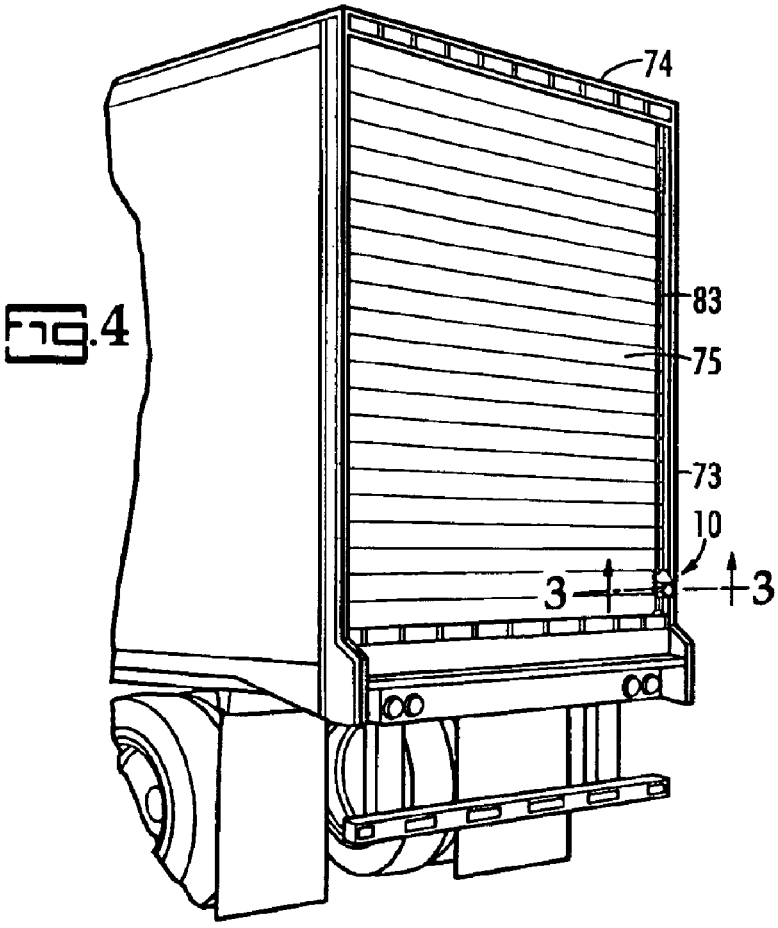
FIG. 4 is a perspective view showing the securing device mounted to a roll-up door of a truck mounted cargo container in accordance with the present invention.

The locking bar 30 includes a base 51 rigidly secured to a locking pin support 52 extending at a right angle from the base 51 and also includes a tab 53 which is welded to the base 51 and also extends at a right angle from the base 51. The base 51 is disposed in the inner chamber 45 and is wider than the locking bar guide channel 56 with portions extending beneath the partition wall 11. The locking pin support 52 and the tab 53 extend through the channel 56 and serve to guide the locking bar 30 between its retracted non-locking position shown in FIG. 2 and its locking position shown in FIG. 3. The tab 53 includes a cylindrical bore or opening 55 for receiving the locking rod 71 of the lock 21. The locking pin support 52 has a locking pin 50 rigidly secured thereto which is parallel to the channel 56. The tab 53 and the locking pin support 52 are guided by the channel 56 and thus the locking bar 30 and the locking pin 50 are guided by the channel 56 between their unlocking position shown in FIG. 2 and their locking position shown in FIG. 3, in which the locking pin 50 extends into a locking pin receiving aperture 72 formed in a door frame 73 of a cargo container 74, as shown in FIG. 4.

Adjacent to and directly behind the rear wall 14 are a pair of plates 76, 77 which are welded at their peripheral edges to each other and to the rear wall 14. The plate 77 has an annular opening 78 for receiving the tapered head of a bolt 24 and the plate 76 includes a square opening 79 for receiving the square segment of the bolt 24 between its head and its threaded portion, which as shown in FIG. 3 extends through a hole drilled in the roll-up door 75 of the cargo container 74. The bolt 24 is secured by a flat washer 25, a lock washer 26 and a nut 27. The bolt 24 may be removed from the locking device 10 and the door 74 when the lock 21 is not in the locking device 10 and the locking bar 30 is in its locking position. Conventional or specialized adhesives or sealants may be used on the bolt 24 and the hex nut 27 to prevent movement of the same. Alternatively, the housing 12 may be affixed to the door 75 using a variety of known techniques including, by way of example and not limitation, welding the back plate 76 to the door 75. The plate 77 includes a lock parking bracket 81 having a locking rod hole 82, which allows the lock 21 to be locked to the bracket 81 when the cargo container door 75 is opened. This feature prevents the lock 21 from being misplaced or lost. The lock 21 typically includes a rivet tab, not shown, to which one end of a security chain, not shown, may be attached. The other end of the security chain can be riveted to the housing 12 by using a hole 57 provided in the lower wall 18.

The security device 10 includes a roof 91 which slopes at a 45° angle. The roof 91 is designed to deflect blows from a sledgehammer, or the like, used by thieves attempting to gain access to the cargo container 74. A vertically depending slot 54 is formed in one side of the security device housing 12 for accommodating one of the door cables 83 typically installed with roll up doors. When the security device 10 is installed as shown in FIGS. 3 and 4, the locking pin support 52 has a relatively close fit with the rectangular opening 47 of the side wall 17, thereby providing good lateral reinforcement for the locking pin 50. This security device is inexpensive protection against cargo container larceny. It can be installed on existing containers, garages or storage facilities with inexpensive tools in a short period of time.

What is claimed is:

1. A security device for locking a door to a door frame which has a locking pin receiving aperture, comprising:

a puck shaped shackleless lock having a locking rod and a key-receiving portion, a rigid housing having a rear wall adapted for rigid connection to said door, a sidewall structure rigidly secured to said rear wall and extending outwardly therefrom to define a chamber having a front opening, said sidewall structure including a pair of parallel lateral side walls, a partition wall rigidly secured to said sidewall structure in spaced and parallel relation to said rear wall dividing said chamber into an outer compartment accommodating said lock and an inner compartment, said partition wall having a centrally positioned locking bar guide channel, a slot in one of said lateral sidewalls outwardly of said partition wall adapted to receive said key receiving portion of said puck shaped lock, and an opening in the other of said lateral side walls, said opening being aligned with said guide channel, a locking bar guided by said locking bar guide channel and axially shiftable between a locking position and an unlocking position, said locking bar having, a base in said inner compartment wider than said guide channel, a locking pin support rigidly secured to said base and extending outwardly through said channel, a locking pin rigidly secured to said locking pin support and extending axially toward said opening in said other side wall, and a tab rigidly secured to said base in laterally spaced relation to said locking pin support and extending outwardly through said channel, said tab including an opening for receiving said locking rod of said puck shaped shackleless lock when said lock is placed in said outer compartment and said locking bar is in its locking position, said locking pin extending into said pin receiving aperture of said door frame when said door is in a predetermined adjacent position and said locking bar is in its locking position.

2. The securing device of claim 1 wherein said housing includes a top wall sloping downwardly and forwardly from said rear wall at an acute angle to said rear wall.

3. The securing device of claim 1 having a lock parking bracket depending downwardly from said housing including an opening for receiving said locking rod of said puck shaped lock.

4. The securing device of claim 1 having an opening in said rear wall for receiving a bolt by which said housing is attachable to said door.

5. The securing device of claim 1 wherein said door is a roll up door.

6. The securing device of claim 5 having a cable accommodating slot in said one lateral side wall, said slot opening into said inner compartment.

7. The security device of claim 1 wherein said locking pin support has a close fit with said opening in said other lateral wall when said locking bar is in its locking position.

* * * * *